US007406733B2

(12) United States Patent
Coffield et al.

(10) Patent No.: US 7,406,733 B2
(45) Date of Patent: Aug. 5, 2008

(54) ELASTOMERIC FABRIC LOAD BEARING SURFACE

(75) Inventors: Timothy P. Coffield, Grand Rapids, MI (US); Daniel S. Sommerfeld, Kalamazoo, MI (US); Joseph D. Ward, Grand Rapids, MI (US)

(73) Assignee: Illinois Tool Works Inc., Glenview, IL (US)

( * ) Notice: Subject to any disclaimer, the term of this patent is extended or adjusted under 35 U.S.C. 154(b) by 390 days.

(21) Appl. No.: 11/128,473

(22) Filed: May 13, 2005

(65) Prior Publication Data

US 2006/0255645 A1 Nov. 16, 2006

(51) Int. Cl.
*A47C 7/02* (2006.01)

(52) U.S. Cl. ..... 5/652.1; 5/653; 297/452.15; 297/452.56

(58) Field of Classification Search ..... 5/453, 5/690, 652.1, 653, 186.1; 297/452.15, 452.56
See application file for complete search history.

(56) References Cited

U.S. PATENT DOCUMENTS 2,233,592 A * 3/1941 Dunajeff ..... 428/604
4,399,574 A 8/1983 Schuman et al.
4,713,854 A 12/1987 Graebe et al.
4,826,249 A 5/1989 Bradbury et al.
4,980,936 A 1/1991 Frickland et al.
5,025,519 A 6/1991 Spann et al.
6,254,190 B1 7/2001 Gregory
6,378,949 B1 4/2002 Maeda et al.
6,755,477 B2 * 6/2004 Chow ..... 297/452.56
7,152,929 B2 * 12/2006 Wu ..... 297/452.56
2001/0030457 A1 10/2001 Gregory
2005/0116526 A1 6/2005 VanDeRiet et al.

FOREIGN PATENT DOCUMENTS

FR 2431272 2/1980

* cited by examiner

*Primary Examiner*—Alexander Grosz
(74) *Attorney, Agent, or Firm*—Warner Norcross & Judd LLP

(57) ABSTRACT

An elastomeric fabric load bearing surface having a non-linear force/deflection profile. In one embodiment, the load bearing surface includes multiple layers, at least one of which is an elastomeric fabric. The various layers cooperate with one another to define a non-linear force/deflection profile. In one embodiment, the load bearing surface includes an upper layer of elastomeric fabric and a lower layer of elastomeric fabric, and the two layers are stretched in different directions. In a second aspect, the load bearing surface includes at least one layer of elastomeric fabric that follows a non-linear pattern. In one embodiment of this second aspect, the fabric defines a body-supporting surface and includes a plurality of undulations away from the body-supporting surface.

16 Claims, 7 Drawing Sheets

ELASTOMERIC FABRIC LOAD BEARING SURFACE

BACKGROUND OF THE INVENTION

The present invention relates to load bearing surfaces, and more particularly to elastomeric fabric load bearing surfaces, such as the seat or back of a chair or bench, or the support surface of a bed, cot or other similar body-supporting product.

There is a continuing effort to develop new and improved load bearing surfaces for use in body-supporting applications, such as the support surfaces in seating, cots and beds. It is desirable for load bearing surfaces to be, among other things, comfortable, durable and relatively inexpensive to manufacture and assemble.

There is an increasing use of elastomeric load bearing fabrics in the seating industry. For example, there are a variety of office chairs available from well-known suppliers that include seat and back portions manufactured from elastomeric fabric. In a conventional application of this type, a layer of elastomeric fabric is stretched across a frame over an opening. In use, the elastomeric fabric elastically deflects to provide a resilient, somewhat cushion-like response to a load. Elastomeric load bearing fabrics are typically manufactured from a weave of elastomeric monofilaments and multifilament yarns, but may include other woven and non-woven constructions. For example, some elastomeric fabrics are woven entirely from elastomeric monofilaments (i.e. the fill yarns are replaced by elastomeric filaments). Elastomeric load bearing fabrics provide a comfortable, elastic, ventilated surface. Although elastomeric fabric surfaces can be quite comfortable in many applications, they are not ideal in all body-support applications. Conventional elastomeric fabric surfaces typically deflect like a sling when a load is applied. Some ergonomists refer to this type of deflection as "hammocking" and consider it undesirable because it can cause the hips to rotate upward. This rotation of the hips can cause discomfort, particularly over extended periods. To minimize the degree of hammocking, many elastomeric fabric surfaces are stretched even more tightly than might otherwise be desired. Although this can reduce the amount of deflection that occurs under load (and therefore reduce the degree of hammocking), it can have an unintended negative impact on comfort. More specifically, stretching the fabric tighter will reduce the cushion-like feel of the surface making it feel more like a tightly stretched drum.

Accordingly, there remains a need for an elastomeric fabric load bearing surface that overcomes the limitation of existing constructions.

SUMMARY OF THE INVENTION

The aforementioned problems are overcome by the present invention which provides an elastomeric fabric load bearing surface with a tunable, non-linear force/deflection profile. More particularly, the present invention provides an elastomeric fabric load bearing surface having a non-linear change in deflection in response to increased loads.

In one embodiment, the present invention provides a multilayer load bearing surface in which the various layers cooperate to define a non-linear force/deflection profile. In this embodiment, the load bearing surface includes at least one layer of an elastomeric fabric coupled with one or more additional support layers. The additional support layers may also be elastomeric fabric, but may alternatively be other load bearing materials, such as elastomeric membranes or conventional fabrics. As a load is increasingly applied to the first layer, the second and any additional layers become increasingly engaged by the load. This results in a surface that provides greater support in response to greater deflection. The specific force/deflection profile of the load bearing surface can be controlled by varying the number and characteristics of the various layers.

In one embodiment, at least one of the various layers is provided with different support characteristics in one or more specific regions. This permits a high degree of regional control over the overall profile of the load bearing surface. For example, in a two-layer embodiment, the lower layer can define one or more openings. The openings can be positioned to coincide with the gluteal portions of the occupant's body, thereby reducing pressure on the ischium bones and providing a more cushion-like feel to the occupant. The number of layers, material selection and other characteristics of the load bearing surface can be controlled to provide the desired force/deflection profile.

In a second embodiment of the present invention, the load bearing surface includes a load bearing fabric that is configured in a non-linear pattern. For example, the fabric may follow a wave-like pattern. As the load increasingly deflects the fabric, more and more of the fabric becomes engaged by the load. As a result, the fabric provides increasing support for greater loads in a non-linear manner. The size, location, configuration and other characteristics of the wave, as well as the characteristics of the fabric can be varied to provide control over the profile of the surface.

The present invention provides a comfortable, highly tunable elastomeric fabric load bearing surface. The elastomeric fabric load bearing surface is relatively inexpensive to manufacture, and provides a light-weight surface that can be ventilated to inhibit heat retention. The present invention provides a load bearing surface having a non-linear force/deflection profile that can be tuned to exhibit support characteristics that are particularly well suited for use in seating applications. If desired, the load bearing surface can be tuned to closely mimic the support characteristics of conventional cushion sets. Further, if desired, select regions of the load bearing surface can be varied to provide localized control over the characteristics of the surface. For example, in multilayer applications, one or more of the layers may include openings to provide reduced pressure in select regions. As another example, in applications with non-linear fabric, the configuration of the fabric can be varied from region to region to provide the regions with different load bearing characteristics.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
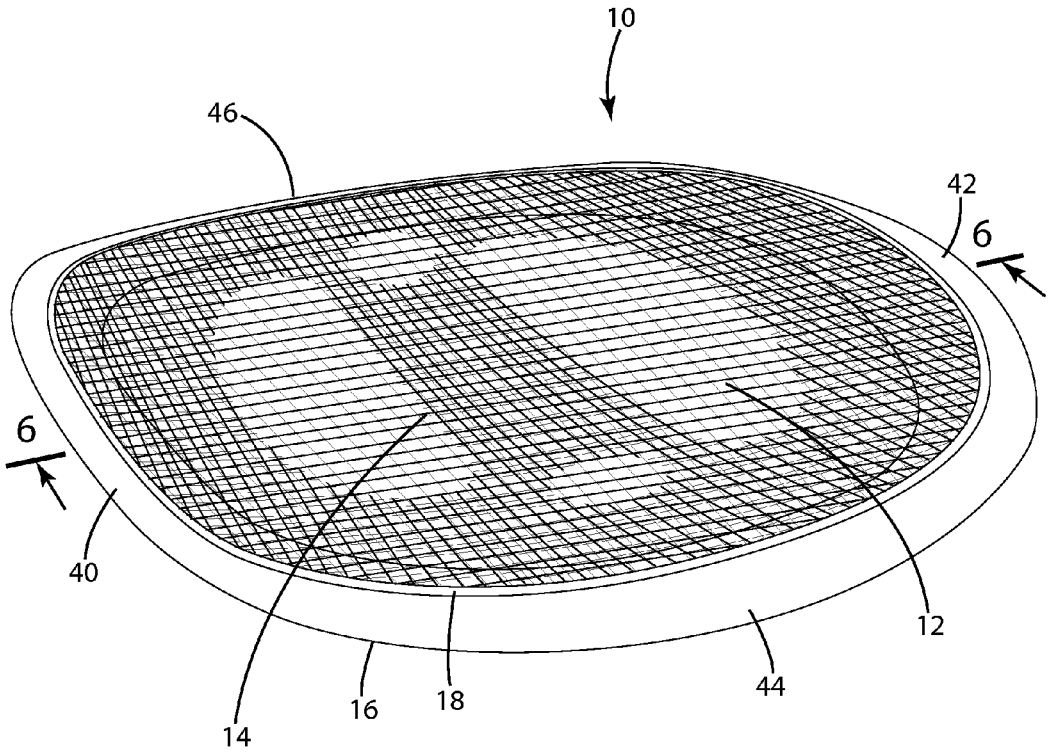
FIG. 1 is a perspective view of an elastomeric fabric load bearing surface in accordance with one embodiment of the present invention.

A load bearing surface 10 according to one embodiment of the present invention is shown in FIG. 1. The load bearing surface 10 shown in FIG. 1 is intended for use as a chair seat, and it includes an upper layer 12 and a lower layer 14 that are suspended from a chair seat frame 16. The frame 16 may in turn be mounted to a chair pedestal (not shown). The upper layer 12 is stretched over the lower layer 14 and is deflectable under a load. As the upper layer 12 increasingly deflects under a load (not shown), the lower layer 14 is increasingly engaged. As a result, the two layers 12 and 14 cooperate to define the overall force/deflection profile of the load bearing surface 10. For purposes of disclosure, the present invention is described in connection with various alternative embodiments intended primarily for use in seating applications. The present invention is not, however, limited to use in seating applications, but may also be incorporated into other load bearing applications. The support characteristics of the load bearing surface 10 are highly adjustable, thereby permitting the load bearing surface 10 to be tailored to support a variety of loads in a variety of different applications.

Figure 7:
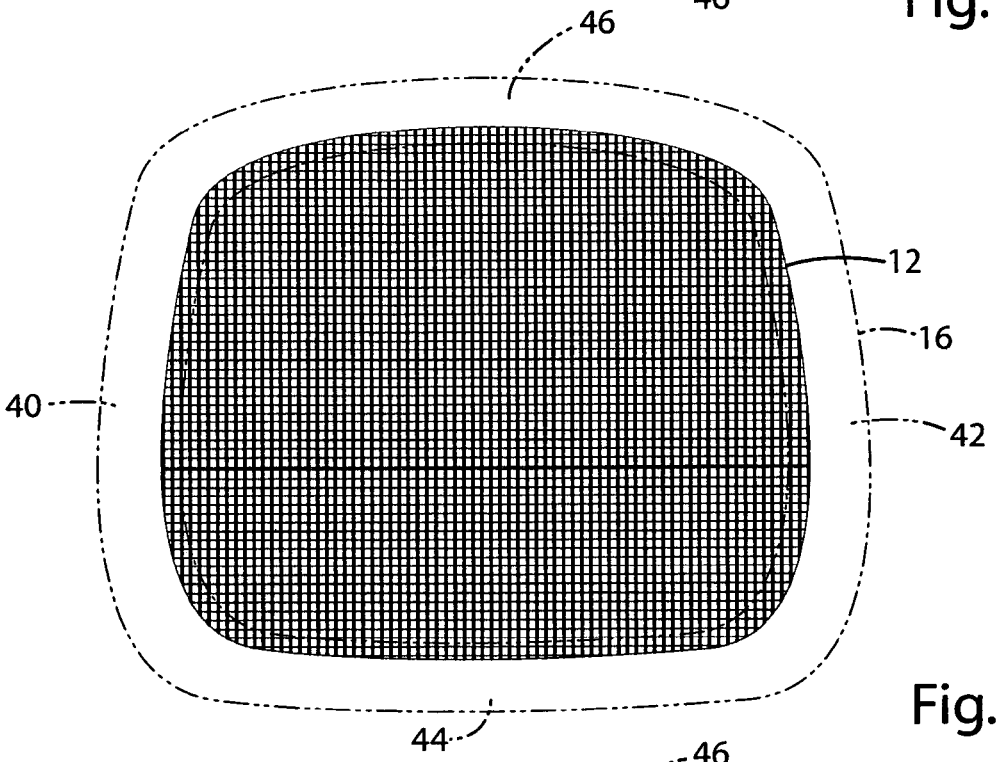
FIG. 7 is a top plan view of the upper layer.
Figure 8:
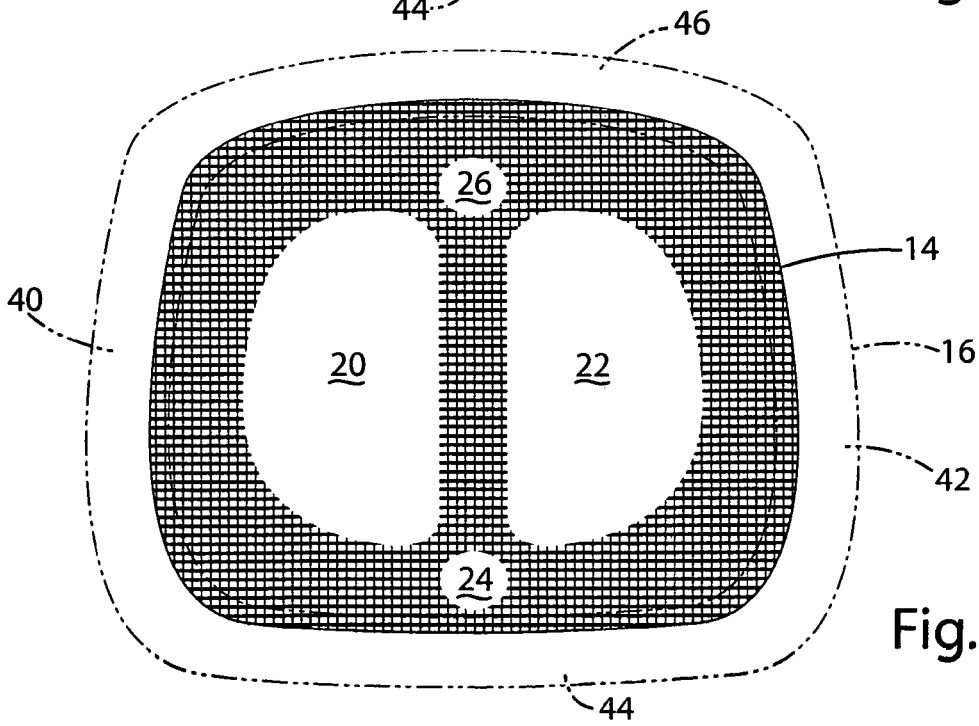
FIG. 8 is a top plan view of the lower layer.

As noted above, the load bearing surface 10 generally includes an upper layer 12 (See FIG. 7) and a lower layer 14 (See FIG. 8) that are secured to a frame 16. In this embodiment, the upper layer 12 of the load bearing surface 10 is manufactured from an elastomeric fabric. Although the elastomeric fabric may be essentially any woven or non-woven elastomeric fabric, the elastomeric fabric of the illustrated embodiment includes elastomeric monofilaments woven together with multifilament yarns or other fill yarns. In this embodiment, the elastomeric monofilaments are manufactured from a thermoplastic elastomer block copolymer. One suitable material of this type is available from DuPont under the Hytrel® trademark. The present invention is not, however, limited to any particular elastomeric material and, to the contrary, may include essentially any elastomeric filaments (monofilament or multifilament). As an alternative to the use of fill yarn, the fabric may include elastomeric filaments extending in both directions. If desired, the warps and wefts of the elastomeric fabric may be welded together at their intersections. The precise construction of the load bearing fabric may vary from application to application depending in part on the anticipated load and desired support characteristics. For purposes of disclosure, the elastomeric fabric is illustrated in the drawings with a weave that is unrealistically open for most application. Although there may be applications where a weave that is open to the illustrated degree is desired, the elastomeric fabric will include a much tighter weave in typical applications.

The lower layer 14 may be spaced apart from the upper layer 12, in whole or in part, so that the spaced-apart region(s) do not interact with the load until the upper layer 12 has deflected a determined amount under load. Although the lower layer 14 may be an elastomeric fabric, it may alternatively be other types of load bearing materials. For example, the lower layer 14 may be a non-elastomeric fabric, such as canvas, or an elastomeric membrane, such as a molded elastomeric film. Although the illustrated embodiment includes two layers, the number of layers may vary from application to application. For example, the load bearing surface 10 may include a third layer (not shown) positioned below lower layer 14 to allow further control over the force/deflection profile of the load bearing surface once the third layer becomes engaged by the load.

Figure 2:
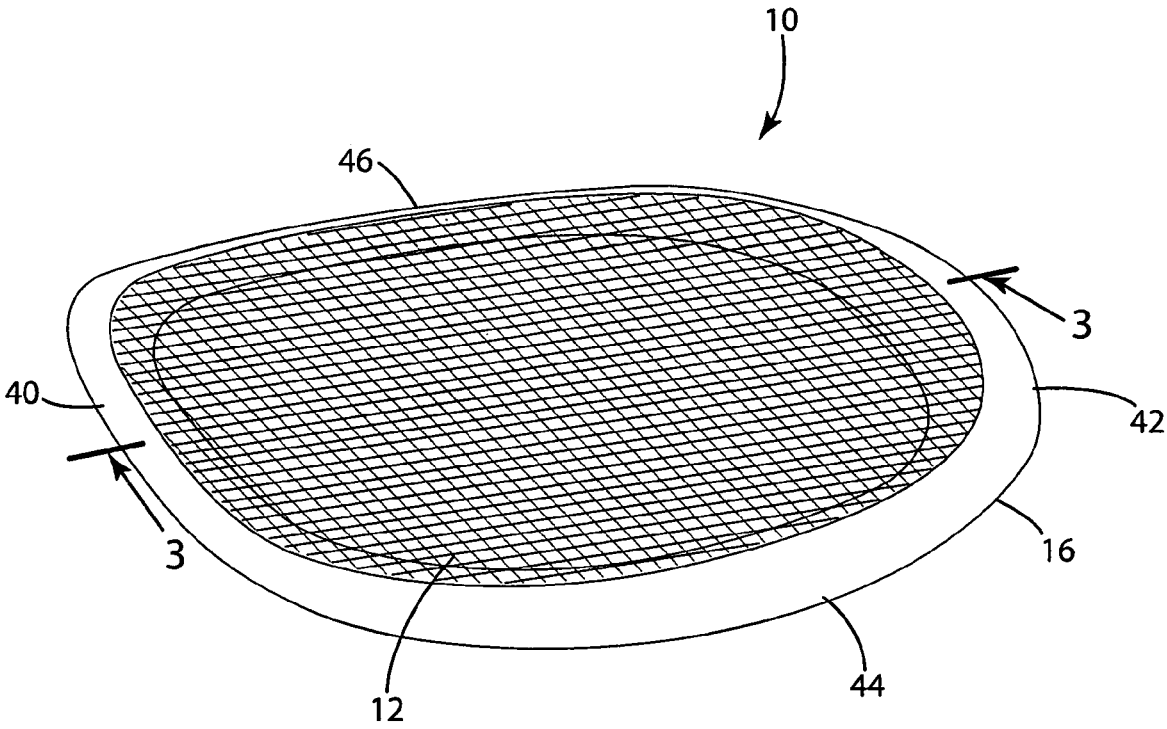
FIG. 2 a perspective view of the load bearing surface with the lower layer removed.
Figure 3:
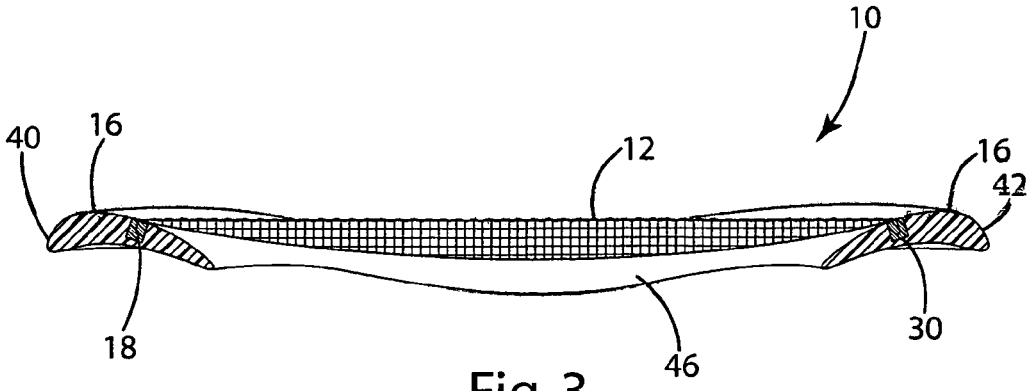
FIG. 3 is a sectional view of the load bearing surface with the lower layer removed taken along line 3-3 of FIG. 2
Figure 4:
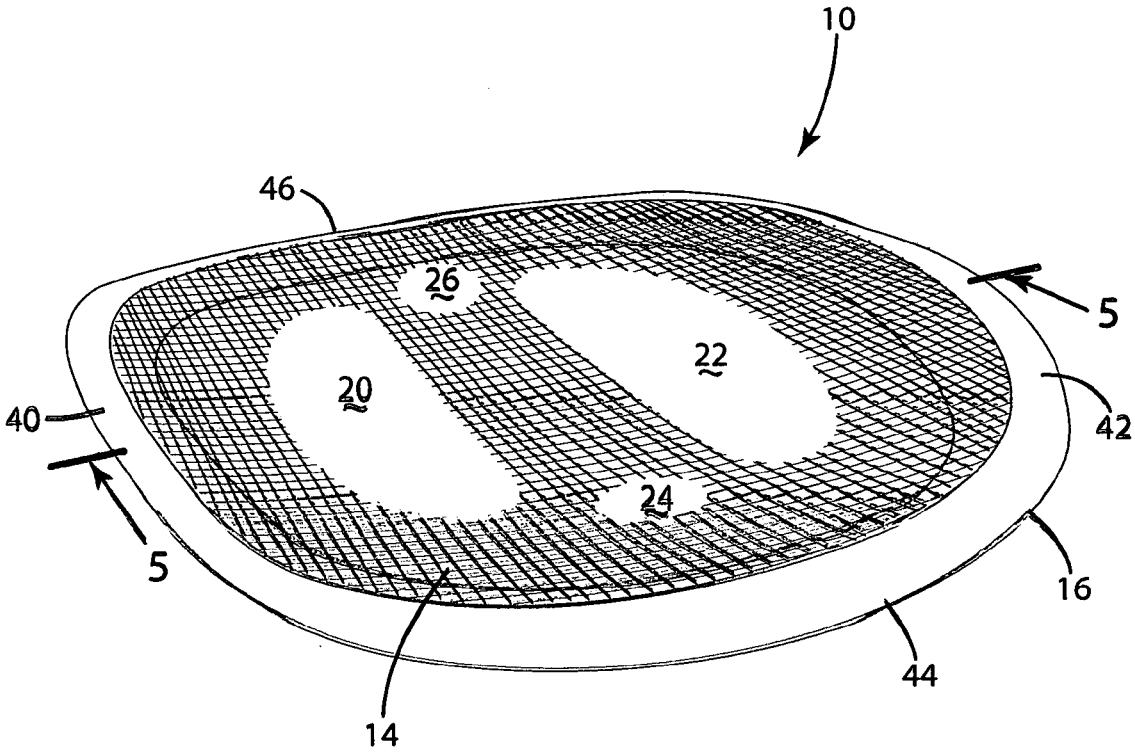
FIG. 4 a perspective view of the load bearing surface with the upper layer removed.
Figure 5:
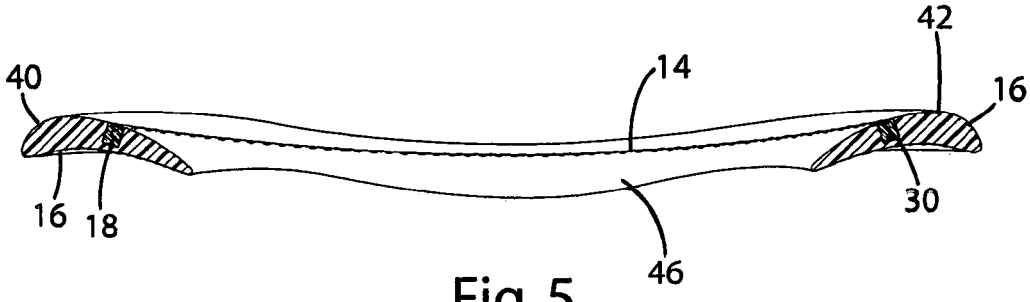
FIG. 5 is a sectional view of the load bearing surface with the upper layer removed taken along line 5-5 of FIG. 4.
Figure 6:
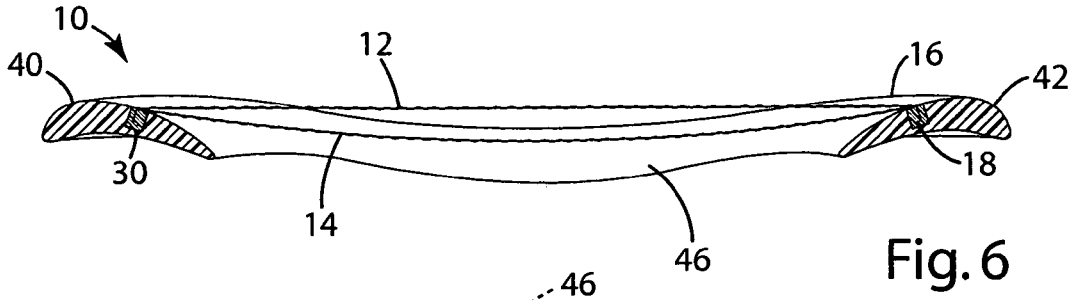
FIG. 6 is a sectional view of the load bearing surface taken along line 6-6 of FIG. 1.

In the embodiment shown in FIGS. 1-8, the load bearing surface 10 is configured to function as the seat of a chair. In this embodiment, the elastomeric fabric of the upper layer 12 is stretched from side to side with respect to the seat frame 16. FIGS. 2 and 3 are an illustration of the load bearing surface 10 with the lower layer 14 removed to show the general shape of the upper layer 12 when stretched. In this embodiment, the left portion 40 and right portion 42 of the frame 16 are somewhat convex. As a result of the convex shape of the left and right portions 40 and 42, stretching causes the upper layer 12 to follow a generally convex shape, with a gradual curve extending from front to back. As perhaps best seen in FIG. 3, the upper layer 12 is generally linear in the direction of stretch (i.e. from left to right) despite the curve in the front to back direction. In the embodiment of FIG. 1, the lower layer 14 is, like the upper layer 12, an elastomeric fabric. The lower layer 14 is stretched from front to back with respect to the seat frame 16. FIGS. 4 and 5 show the load bearing surface 10 with the upper layer 12 removed to highlight the contours of the lower layer 14. In this embodiment, the front portion 44 and back portion 46 of the frame 16 are somewhat concave. As a result of the concave shape of the front and rear portions 44 and 46, the stretched lower layer 14 follows a generally concave shape, with a gradual curve extending from left to right. When the upper layer 12 and lower layer 14 are combined, the convex and concave profiles cooperate to provide significant spacing between the two layers, particularly towards the center of the seat (See FIG. 6).

The load bearing surface 10 resulting from the combination of upper layer 12 and lower layer 14 provides a non-linear force/deflection profile. More specifically, as a load is initially applied to the surface, it engages only the upper layer 12. As the load increases and the upper layer 12 deflects, it moves toward the lower layer 14. When the upper layer 12 deflects a sufficient amount, it comes into engagement with the lower layer 14. Once this happens, the upper layer 12 and lower layer 14 cooperate to support the load. As a result of the additional support provided by the lower layer 14, the overall support of the load bearing surface 10 increases in a non-linear manner upon engagement of the lower layer 14. The spacing between the upper layer 12 and lower layer 14 may be varied to provide some control over the load required to engage the lower layer 14. Further, the spacing may be varied in different regions of the load bearing surface 10 to provide region control over the force required to engage the lower layer 14.

If desired, one or more layers of the load bearing surface 10 can be provided with regions of differing support. For example, in the illustrated embodiment, the lower layer 14 defines a plurality of openings 20, 22, 24 and 26. These openings are positioned on the lower layer 14 to coincide with select pressure points, such as the ischium bones. As a result, the support characteristics of the load bearing surface 10 are different in these regions once the lower layer 14 is engaged by the load. More specifically, these openings 20, 22, 24 and 26 provide the lower layer 14 with regions that exhibit less resistance to deflection, relying essentially on the upper layer 12 for support. Accordingly, they minimize pressure points in the open regions. The number, size and location of the openings may vary from application to application as desired to tune the characteristics of the load bearing surface 10 to a specific application. The support characteristics of any given layer can be varied from region to region in alternative ways. For example, in applications were the layer to be tuned is a sheet material, the thickness of the sheet may be varied from region to region or the sheet may be perforated in select regions. In applications were the layer to be tuned is a fabric, examples include varying the characteristics of the fabric strands from region to region, stretching the fabric different amounts in different regions, adding additional support strands in select regions, welding the intersecting strands of the fabric together only in select regions or, as noted above, by varying the spacing of the layers in select regions.

The various layers 12 and 14 of the load bearing surface 10 can be secured to a support structure in essentially any way capable of supporting the intended loads. In the illustrated embodiment, the load bearing surface 10 includes a frame 16 and a single carrier 18 for attaching the layers 12 and 14 to the frame 16. The frame 16 is a relatively rigid component providing a majority of the structural support for the seat. The frame 16 may be manufactured from suitable structural plastics, for example, by injection molding. The frame 16 may define a channel 30 to receive the carrier 18. The carrier 18 of this embodiment provides a structure for securing the layers 12 and 14 to the frame 16. During manufacture, the carrier 18 may be interconnected with the upper layer 12 and the lower layer 14 and then the assembly may be connected to the frame 16. For example, the carrier 18 may be connected to the frame 16 within the channel 30 by fasteners, adhesives or through the use of slots and locking tabs (not shown) built into the carrier 18 and frame 16. Alternatively, the two layers 12 and 14 may be attached to separate carriers (not shown) and then each carrier (not shown) can be separately secured to the frame 16.

The various layers 12 and 14 can be secured to the carrier 18 (or carriers) in essentially any way capable of supporting the intended loads. In one embodiment, the carrier 18 is molded in situ about the two layers 12 and 14. In one specific example of this construction, the two layers 12 and 14 are secured to the carrier 18 by pre-stretching the two layers 12 and 14 and then holding the two layers 12 and 14 in the stretched state within the carrier mold (not shown) while the carrier 18 is molded in situ onto the layers 12 and 14. U.S. Pat. No. 6,702,390 to Stumpf et al discloses structure for performing a similar manufacturing process including only a single layer of fabric. The apparatus of U.S. Pat. No. 6,702,390 can be readily modified for use with the present invention by incorporating a second loom for holding the second layer. U.S. Pat. No. 6,702,390 is incorporated by reference into this application in its entirety. If desired, a separate carrier may be molded to each layer so that each layer may be separately attached to the frame.

Alternatively, the carrier 18 can be molded in situ about two layers 12 and 14 when the two layers are in a relaxed state. In this embodiment, the carrier 18 may be manufactured from a stretchable material that permits the carrier 18 and the layers 12 and 14 to be stretched together. The stretched assembly of carrier 18 and layers 12 and 14 may be attached to the frame 16, which retains the assembly in the stretched condition. U.S. Pat. No. 6,540,950 to Coffield discloses an attachment structure of this type and is incorporated by reference into this application in its entirety. In applications where the two layers 12 and 14 are to be subject to the same stretch, a single carrier 18 can be simultaneously molded to both layers 12 and 14. In applications where each layer 12 and 14 is to be subjected to a different stretch (e.g. stretched in different directions and/or stretched to different amounts), separate carriers (not shown) can be molded to each layer 12 and 14, and the two carriers can be separately stretched and attached to the frame 16.

In another alternative, the attachment construction may include a single carrier 18 having two halves that are closed about the layers 12 and 14 to hold them in place. An attachment construction of this type is shown in U.S. Pat. No. 6,511,562 to Coffield, which is incorporated by reference into this application in its entirety. If there is a desire to space the layers 12 and 14 apart from one another along the edges, the carrier may include one or more additional parts (not shown) positioned between the layers 12 and 14. For example, if it is desirable to space two layers, the carrier may include a third part corresponding in overall shape with the two carrier halves. This third part may be positioned between the layers 12 and 14 and between the two carrier halves. The various carrier parts and layers may be interconnected by fasteners, such as screws, or by adhesives, such as cement.

In another alternative, the carrier(s) can be eliminated and the layers can be directly attached to the support structure (e.g. frame 16). For example, the frame 16 can be molded in situ directly onto the upper and lower layers 12 and 14. As another example, the frame 16 may include two halves that clamp about the edges of the layers 12 and 14. If desired, additional frame parts (not shown) may be sandwiched between the various layers to provide spacing between the layers. The present invention is not limited to applications in which the layers 12 and 14 are secured to a single frame 16. Rather, the load bearing surface 10 may be supported on multiple frames, for example, by incorporating a separate frame for each layer.

Figure 9:
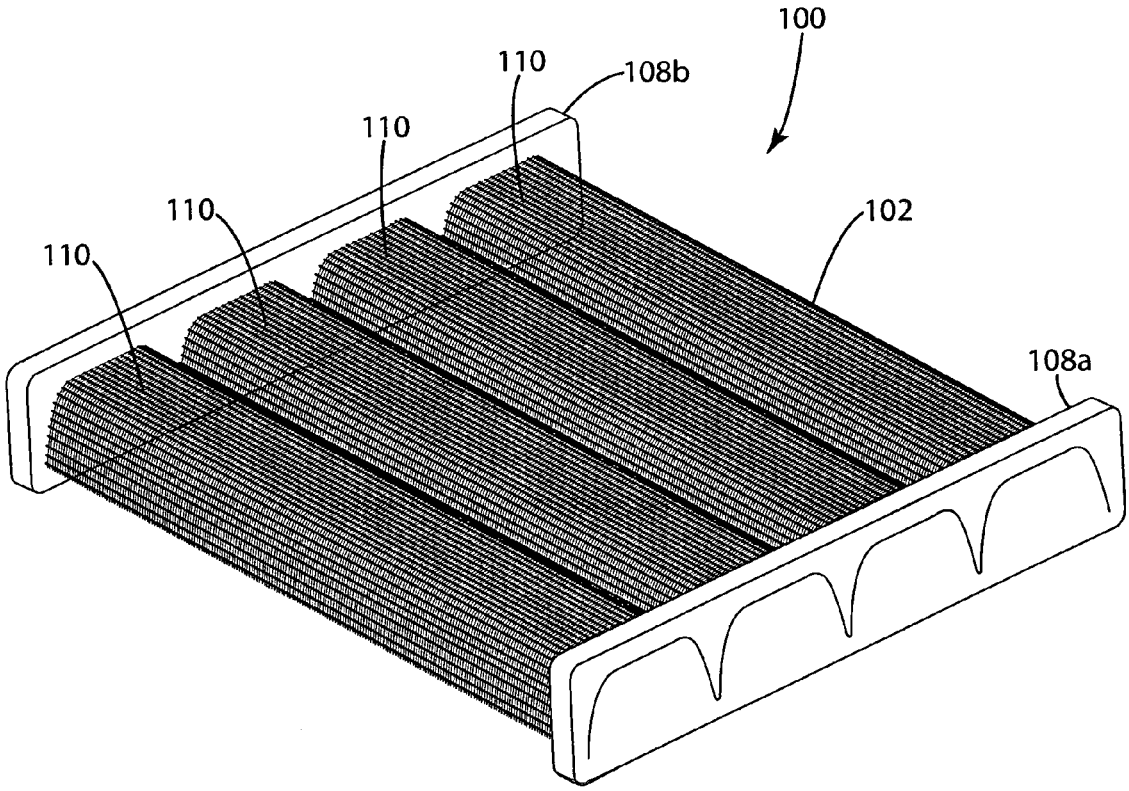
FIG. 9 is a perspective view of a load bearing surface in accordance with a second aspect of the present invention.
Figure 11:
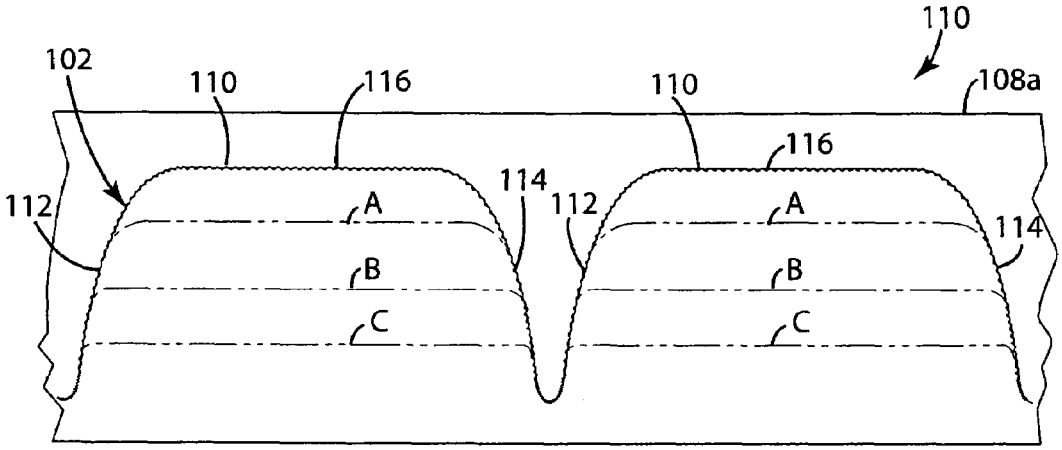
FIG. 11 is an enlarged side elevational of a portion of the load bearing surface.
Figure 12:
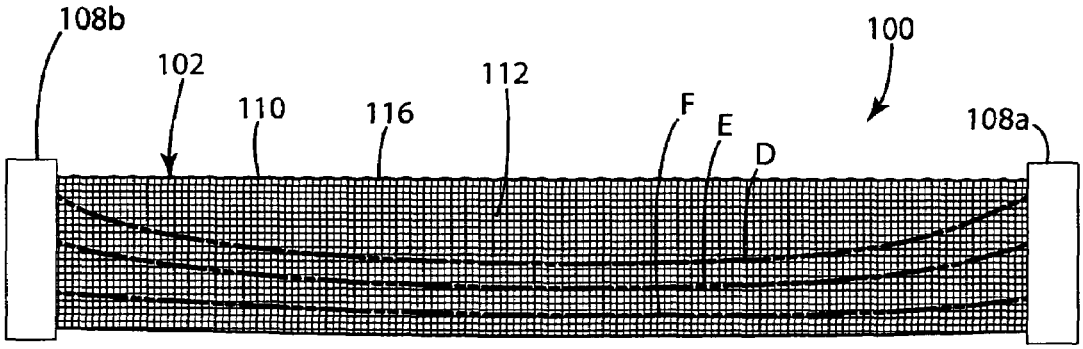
FIG. 12 is a sectional view of the load bearing surface taken along line 12-12 of FIG. 10.

Another embodiment in accordance with a second aspect of the present invention is show in FIG. 9. In this embodiment, the present invention includes a load bearing surface 100 having an elastomeric fabric 102 that is stretched over an opening and is configured to follow a non-linear pattern. The non-linear pattern is configured to provide the load bearing surface 100 with a controlled, non-linear force/deflection profile. More specifically, the fabric 102 follows a pattern of undulations 110 that provide the load bearing surface with depth in the direction of deflection. Operation of the load bearing surface 100 is described in connection with FIGS. 11 and 12. FIG. 11 shows the undulations 110 in the unloaded state in solid lines and shows the deflection of the undulations 110 under increasing loads in phantom lines A, B and C. As the load sinks deeper into the undulations 110, it engages an increasingly greater number of fabric strands or filaments. For example, FIG. 12 includes a lines D, E and F that show varying degrees of deflection in an undulation 110. When the fabric 102 deflects from its unloaded position to line D, the load becomes engaged by each of the horizontally extending strands disposed between the relaxed position and line D. Similarly, additional deflection, for example, from line D to line E or line F results in the engagement of even more horizontal strands. As the number of engaged strands increases, the overall stiffness of the load bearing surface increases. Accordingly, the load bearing surface 100 becomes increasingly stiffer as the occupant sits deeper in seat. In this way, the load bearing surface 110 has the ability to automatically adjust its stiffness to varying loads.

Figure 10:
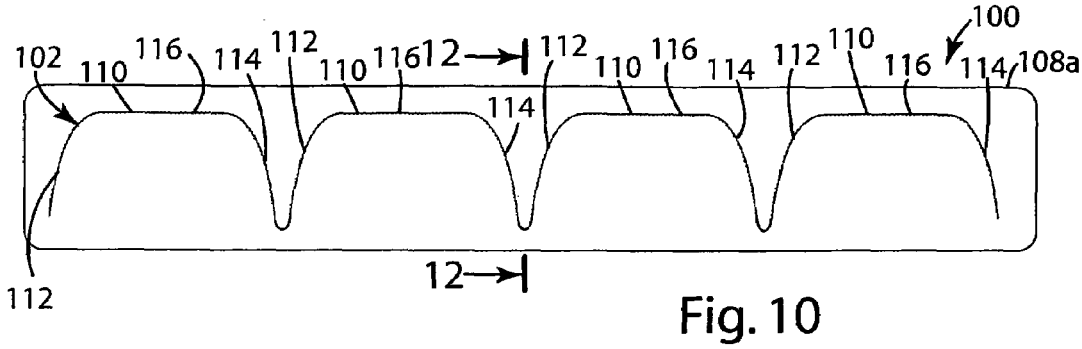
FIG. 10 is a side elevational view of the load bearing surface of FIG. 9.

The load bearing surface 100 of the illustrated embodiment is intended for use as a seat for a chair (not shown). As shown, this particular embodiment includes four largely identical undulations 110 that run parallel to one another and are intended to run from left to right in the assembled chair. In this embodiment, the fabric 102 is stretched in a direction that is coincident with the longitudinal extent of the undulations 110. The degree of stretch applied to the fabric 102 may vary from application to application to provide the desired load bearing characteristics. In this embodiment, the fabric 102 follows a repeating wave-like pattern in which each undulation 110 of the fabric 102 includes angled leading and trailing portions, 112 and 114 respectively, (collectively referred to as transition portions) that are joined by a generally planar central portion 116 (or support portion) (See FIGS. 10 and 11). The central portions 116 of the various undulations 110 cooperatively define a body-supporting surface in the sense that they together define the general extent and shape of the load bearing surface 100 before a load is applied. The body-supporting surface may be planar or may be a curved surface, as desired. For example, the fabric 102 may include central portions 116 that follow a shape corresponding with that of the intended load. The transition portions 112 and 114 extend away from the body-supporting surface so that they become increasingly engaged with the load as the fabric 102 undergoes greater deflection. Although described in connection with a seating application, the present invention is not limited to seating applications, but is well-suited and readily adapted for use in other body-support applications, such as the support surface in a chair back, cot or bed.

The elastomeric fabric 102 may be mounted to a support structure in essentially any manner. In the embodiment of FIGS. 9-14, the load bearing surface 100 includes a caffier 108 that is interconnected with the fabric 102. The caffier 108 may in turn be mounted to a frame, such as the frame 16 shown in connection with the first embodiment, or other support structure, such as the pedestal of a chair (not shown). The carrier 108 may include multiple segments that are affixed to opposite edges of the fabric 102, such as the two segments 108*a* and 108*b* shown in FIG. 9. Alternatively, the caffier 108 may extend continuously around the entire periphery of the fabric 102. In applications with a split carrier, the carrier segments 108*a* and 108*b* may be mounted to a single support structure or to separate support structures that hold the two segments 108*a* and 108*b* apart at the desired tension. As perhaps best shown in FIGS. 10 and 11, the fabric 102 may be secured to the caffier 108*a* in a wave-like configuration. This construction may be achieved in a variety of different ways. For example, the fabric 102 may be held in the desired wavy configuration within a mold cavity (not shown) while the carrier segments 108*a* and 108*b* are molded in place directly onto the fabric 102. As an alternative example, the caffier segments 108*a* and 108*b* may each include upper and lower segment halves that close on opposite sides of the fabric 106 to hold it the desired wave-like pattern. If desired, the carrier 108 may be eliminated and the fabric 106 may be mounted directly to the frame or other support structure using essentially any one of the aforementioned attachment structures.

Figure 13:
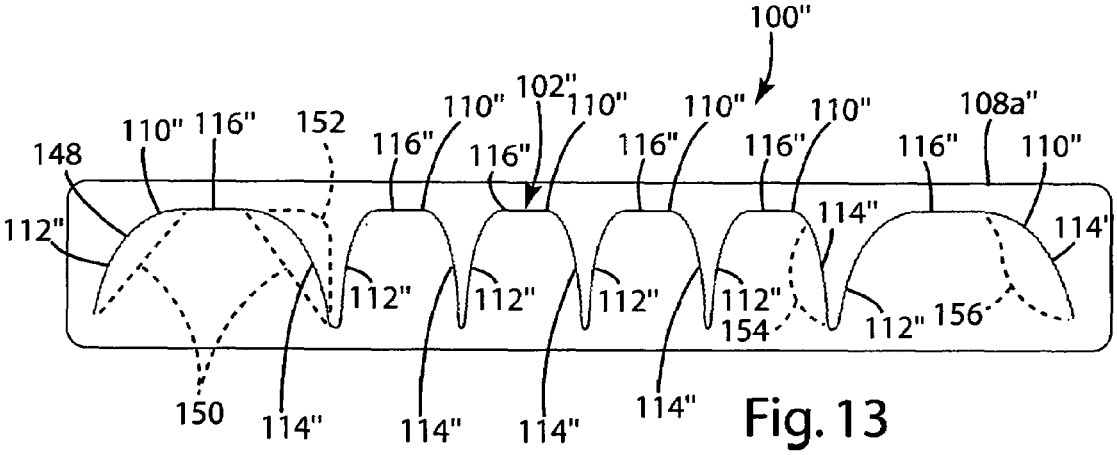
FIG. 13 is a side elevational view of an alternative load bearing surface.
Figure 14:
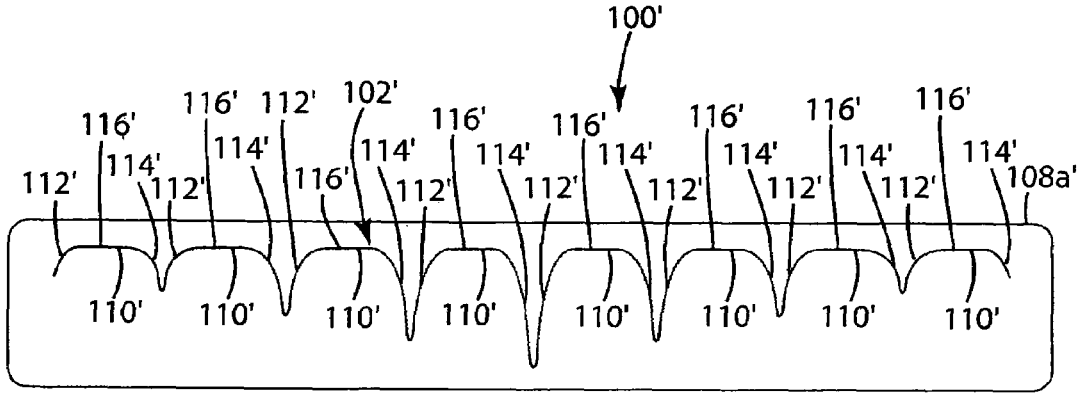
FIG. 14 is a side elevational view of a second alternative load bearing surface.

The number, size, shape and configuration of the undulations in the fabric can be selected to provide control over the force and deflection profile of the load bearing surface. These changes can be uniformly implemented over the entire load bearing surface or may be varied from one region to another across the surface to provide localized control over the support characteristics of the surface. For example, the undulations 110' in the fabric 102' may vary in depth (or height) as necessary to accommodate the desired range of loads, as shown in FIG. 14. In this embodiment, the undulations 110' increase in depth toward the center of the load bearing surface 100'. This embodiment is intended for use in applications where the anticipated load increases toward the center of the load bearing surface 110.' The undulations 110' with a smaller depth require less fabric and therefore may decrease the overall cost of the load bearing surface 100'. The support characteristics of the load bearing surface may also be tuned by varying the number of undulations over a given distance. Referring again to FIG. 14, the number of undulations 110' is twice that disclosed in the embodiment of FIG. 9. This increase in undulations 110' will result in a generally stiffer surface because there are a greater number of transition portions 112' and 114' to support the load. FIG. 13 shows an alternative embodiment in which the number of undulations varies from one region to another across the load bearing surface 100". In this embodiment, there are a greater number of undulations 110" in the center of the load bearing surface 100" than in the front and back. As a result, the center of the load bearing surface 100" will provide a stiffer response to a load. Further, the rate at which the load bearing surface stiffens under load can be controlled by varying the angle of the leading and trailing edges of each undulation. For example, it may be desirable to lessen the angle of the transitions portions in the front and rear regions of the load bearing surface to provide differences in the stiffness between the front, read and central regions. Referring now to FIG. 13, the transition portions 112" and 114" of each undulation may be curved (as exemplified by transition portion 148) or linear (as exemplified by transition portion 150, which is shown in broken lines). Although the transition portions 112" and 114" shown in solid lines are somewhat convex, the transition portions may alternatively be concave, as exemplified by transition portion 156, which is shown in broken lines. The specific curve of the transition portions 112" and 114" can be engineered to provide a high degree of control over the rate at which the seat stiffens. For example, the radius of curvature may vary over the transition portion 112" and 114" to vary the stiffness at different depths. In some applications, it may be desirable for the transition portions to extend at a negative angle such that the central portion overlaps the transition portions. This is exemplified by transition portion 154, which is shown in broken lines. A negative angle will result in the central portion 116" and transition portion 112" or 114" being in an overlapping relationship with respect to the direction of deflection. This can provide an even greater increase in stiffness once the overlapping portions become engaged to cooperatively support the load.

Although this second aspect of the present invention is described in connection with elastomeric fabrics, it may also be implemented with other types of elastomeric membranes, such as elastomeric films. A wide variety of elastomeric materials are suitable for forming alternative elastomeric membranes. These membranes may be molded, cast, extruded or otherwise formed using conventional techniques and apparatus.

The present invention is illustrated in connection with load bearing surfaces intended to extend in a substantially horizontal orientation. The present invention may, however, be incorporated into load bearing surfaces extending at other orientations. For example, the present invention is well-suited for use in vertically extending applications, such as a chair back.

The above description is that of various embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A load bearing surface for a body supporting application comprising:

a support structure;

an elastomeric seating surface secured to said support structure, said seating surface including an initial contact portion being deflectable under a load in accordance with a first deflection profile and a support portion deflectable under a load in accordance with a second deflection profile; and wherein at least one of said initial contact portion and said support portion is an elastomeric fabric having a plurality of elastomeric filaments extending in a first direction, said elastomeric fabric mounted to said support structure in a stretched condition wherein said elastomeric filaments are stretched in said first direction, said support portion including a plurality of undulations in said fabric extending in a second direction different from said first direction, said initial contact portion and said support portion cooperatively define an overall deflection profile for the load bearing surface, whereby an increasing number of said elastomeric filaments become engaged as a load increasingly deflects said elastomeric fabric.

2. The load bearing surface of claim 1 wherein at least one of said initial contact portion and said support portion includes at least one localized variation in load bearing characteristics to provide localized control over the deflection profile of the load bearing surface.

3. A load bearing surface comprising:

a support structure;

an elastomeric membrane including a plurality of elastomeric filaments, said membrane secured to said support structure in a stretched configuration over an opening permitting said elastomeric membrane to deflect under a load, said elastomeric filaments being stretched over said opening in a first direction, said membrane generally extending along and defining a body-supporting surface, said membrane including a plurality of undulations away from said body-supporting surface, each of said undulations having a longitudinal extent extending in said first direction, whereby said plurality of elastomeric filaments becomes increasingly engaged as a load increasingly deflects said membrane.

4. The load bearing surface of claim 3 wherein said elastomeric membrane is further defined as an elastomeric fabric, each of said undulations having a longitudinal extent extending substantially across said elastomeric fabric in said first direction.

5. The load bearing surface of claim 4 wherein each of said undulations includes a leading portion, a trailing portion and a central portion, said central portion extending between said leading portion and said trailing portion, said central portions of said plurality of undulations generally defining said body-supporting surface.

6. The load bearing surface of claim 3 wherein said elastomeric membrane includes a first region and a second region, said first region including a first number of undulations over a given distance, said second region including a second number of undulations over said given distance, said first number being different from said second number.

7. The load bearing surface of claim 3 wherein each of said undulations includes at least one characteristic pre-selected to provide the load bearing surface with a desired deflection profile.

8. A load bearing surface comprising:

a support structure:

an elastomeric membrane secured to said support structure in a stretched configuration over an opening permitting said elastomeric membrane to deflect under a load, said membrane generally extending along and defining a body-supporting surface, said membrane including a plurality of undulations away from said body-supporting surface, whereby said membrane becomes increasingly engaged as a load increasingly deflects said membrane, wherein each of said plurality of said undulations includes a depth, at least one of said undulations having a greater depth than another of said undulations.

9. A load bearing surface for a body supporting application comprising:

a support structure;

an elastomeric membrane having a plurality of elastomeric filaments, said membrane mounted to said support structure with said elastomeric filaments in a stretched condition, said elastomeric membrane including a plurality of support portions cooperatively defining a body-supporting surface and including a plurality of transitions portions extending away from said body-supporting surface forming a plurality of undulations, said undulations each having a longitudinal extent extending substantially across said membrane, said longitudinal extents of said transitions portions being generally parallel to each other.

10. The load bearing surface of claim 9 wherein said elastomeric membrane is further defined as an elastomeric fabric.

11. The load bearing surface of claim 10 wherein each of said support portions are generally planar and at least a portion of each of said transition portions generally extends at an angle to a corresponding support portion of greater than about forty five degrees.

12. The load bearing surface of claim 10 wherein at least one of a characteristic of said elastomeric fabric, a characteristic of said support portions and a characteristic of said transition portions is varied for location to location along the load bearing surface to provide localized control over a deflection profile of the load bearing surface.

13. The load bearing surface of claim 9 wherein a shape of each of said transition portions is selected to provide the load bearing surface with a desired deflection profile.

14. The load bearing surface of claim 9 wherein a number of said plurality of support portions is selected to provide the load bearing surface with a desired deflection profile.

15. The load bearing surface of claim 9 wherein each of said transition portions extends to a depth selected to provide the load bearing surface with a desired deflection profile.

16. The load bearing surface of claim 9 wherein at least one of said transition portions extends along a curve having a varying radius of curvature, said varying radius of curvature selected to provide the load bearing surface with a desired deflection profile.

* * * * *